US007913869B2

(12) United States Patent
Cuocolo, Jr.

(10) Patent No.: US 7,913,869 B2
(45) Date of Patent: Mar. 29, 2011

(54) CONTAINER CAP

(76) Inventor: Joseph M. Cuocolo, Jr., Wilmington, DE (US)

( * ) Notice: Subject to any disclaimer, the term of this patent is extended or adjusted under 35 U.S.C. 154(b) by 603 days.

(21) Appl. No.: 11/971,995

(22) Filed: Jan. 10, 2008

(65) Prior Publication Data

US 2009/0065517 A1 Mar. 12, 2009

(51) Int. Cl.
*B65D 51/18* (2006.01)
*A47G 19/22* (2006.01)
*A47G 21/18* (2006.01)

(52) U.S. Cl. ..... 220/254.2; 220/254.3; 220/254.9; 220/714; 220/717

(58) Field of Classification Search ..... 220/254.2, 220/254.3, 254.9, 707, 714, 717
See application file for complete search history.

(56) References Cited

U.S. PATENT DOCUMENTS 5,203,468 A * 4/1993 Hsu ..... 220/254.3
5,244,113 A * 9/1993 Stymiest ..... 220/710.5
5,582,315 A * 12/1996 Reid ..... 220/254.4
7,059,490 B2 * 6/2006 Son ..... 220/254.3
7,124,907 B2 * 10/2006 Conaway ..... 220/254.1
7,690,524 B2 * 4/2010 Chau ..... 220/254.3
2003/0052126 A1 * 3/2003 Zettle et al. ..... 220/254.3
2005/0133519 A1 * 6/2005 McDonough ..... 220/705
2006/0226110 A1 * 10/2006 Choi et al. ..... 215/228

* cited by examiner

*Primary Examiner* — Anthony Stashick
*Assistant Examiner* — Niki M Eloshway
(74) *Attorney, Agent, or Firm* — Dale J. Ream

(57) ABSTRACT

A cap device for use with a container or bottle includes a spout portion having a trough defining an access hole. The cap device includes a drinking implement coupled to the trough and pivotal between retracted and extended configurations, the drinking implement covering the access hole at the retracted configuration and being in communication therewith at the extended configuration. An upper surface of the cap device defines a cavity adjacent to and in communication with the trough that is configured to receive a person's finger to selectively urge the drinking implement between retracted and extended configurations. The cap device may include a pour portion adjacent the spout portion although the spout portion accounts for a relatively larger area than the pour portion.

15 Claims, 12 Drawing Sheets

CONTAINER CAP

REFERENCE TO RELATED APPLICATIONS

This application claims priority to U.S. application Ser. No. 11/854,368 filed on Sep. 12, 2007 entitled Container Cap.

BACKGROUND OF THE INVENTION

This invention relates generally to beverage containers and dispensing lids and, more particularly, to a cap device for use with a container, such as a beverage container, that includes first and second adjacent portions each having a structure different than the other.

Young children often use what is commonly referred to as a sipper or "sippy" cup to drink milk, juice, or water. This type of cup typically includes a traditional container with a lid having a spout and which generally reduces spills. A disadvantage of a sipper container, however, is that the contents of a larger container, such as a milk or juice jug, must first be deposited into the sipper container and a lid must be attached thereto before the child may access those contents through the sipper spout. This is especially inconvenient when traveling and the milk or juice is obtained from a relatively small bottle that does not have its own sipper lid. Therefore, it would be desirable to have a cap device that could be attached directly to a bottle or other beverage container such that the contents of the container need not first be deposited into a traditional sipper container. While such a cap device may be attached directly to bottles at the point of manufacture, it may also be desirable for consumers to have such a cap device independent of any bottle, so as to attach it to a purchased bottle, such as a bottle of juice, as needed such as when traveling. Older children and adults frequently desire to access beverages through a straw or flip up lid. A "sports bottle" is an example of a convenient means by which individuals conveniently carry and access beverages.

Therefore, it would be desirable to have a container cap having adjacent lid portions each having a different structure for providing access to the contents of the container or bottle. Further, it would be desirable to have a container cap having both a sipper spout and defining a straw opening so that a toddler, an adult, or an older child may conveniently and selectively access the same beverage container. In addition, it would be desirable to have a container cap with multiple access structures that may be screwed onto existing beverage bottles.

SUMMARY OF THE INVENTION

Accordingly, a cap device for use with a beverage container according to the present invention includes a first portion defining an opening for providing access to contents of the container and a cover movable between a closed configuration covering the opening and an open configuration exposing the opening. This first portion may include a straw opening or a larger opening for pouring liquid out of the container. Further, the cap device includes a second portion adjacent the first portion having a trough that defines an access hole. A drinking implement, such as a sipper, may be coupled to the trough that is pivotal between a retracted configuration and an extended configuration. The drinking implement includes open first and second ends and defines a drinking channel therebetween. The drinking implement covers and closes the access hole by abutment when at the retracted configuration. The open second end of the drinking implement is adjacent said access hole when at said extended configuration so that the contents of the container may pass through the access hole, open second end, channel, and open first end. The first and second portions of the cap device may be removably coupled to the container, such as in a threaded arrangement. In another embodiment, the cap device may include a combination of both a larger pour opening and straw opening.

In another embodiment of the invention, a "spout portion" includes a drinking implement that is pivotal in a frontward and rearward movement such that a front face of the drinking implement rests against or is adjacent to a bottom of the trough in a retracted configuration. An upper surface of the cap device defines a cavity adjacent to and in communication with the trough, the cavity having a configuration suitable to receive the finger of a person such that the drinking implement may be selectively moved between the retracted and extended configurations. If a "pour portion" is included with the spout portion, the spout portion accounts for a substantially larger area of the cap device 300 than the pour portion such that the drinking implemented is generally centered on the cap device when at an extended configuration.

Therefore, a general object of this invention is to provide a cap device for selectively accessing the contents of a container.

Another object of this invention is to provide a cap device, as aforesaid, that includes first and second portions, each having a structure different than the other for accessing the contents of the container.

Still another object of this invention is to provide a cap device, as aforesaid, having a sipper that enables a young child to drink from the container, the sipper being movable between retracted and extended configurations.

Yet another object of this invention is to provide a cap device, as aforesaid, having a straw opening or pour opening that enables a user to more conveniently access the contents of the container, the straw or larger opening being selectively covered when not in use.

A further object of this invention is to provide a cap device, as aforesaid, that enables a child or an adult to access the same beverage container through age appropriate access structures.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
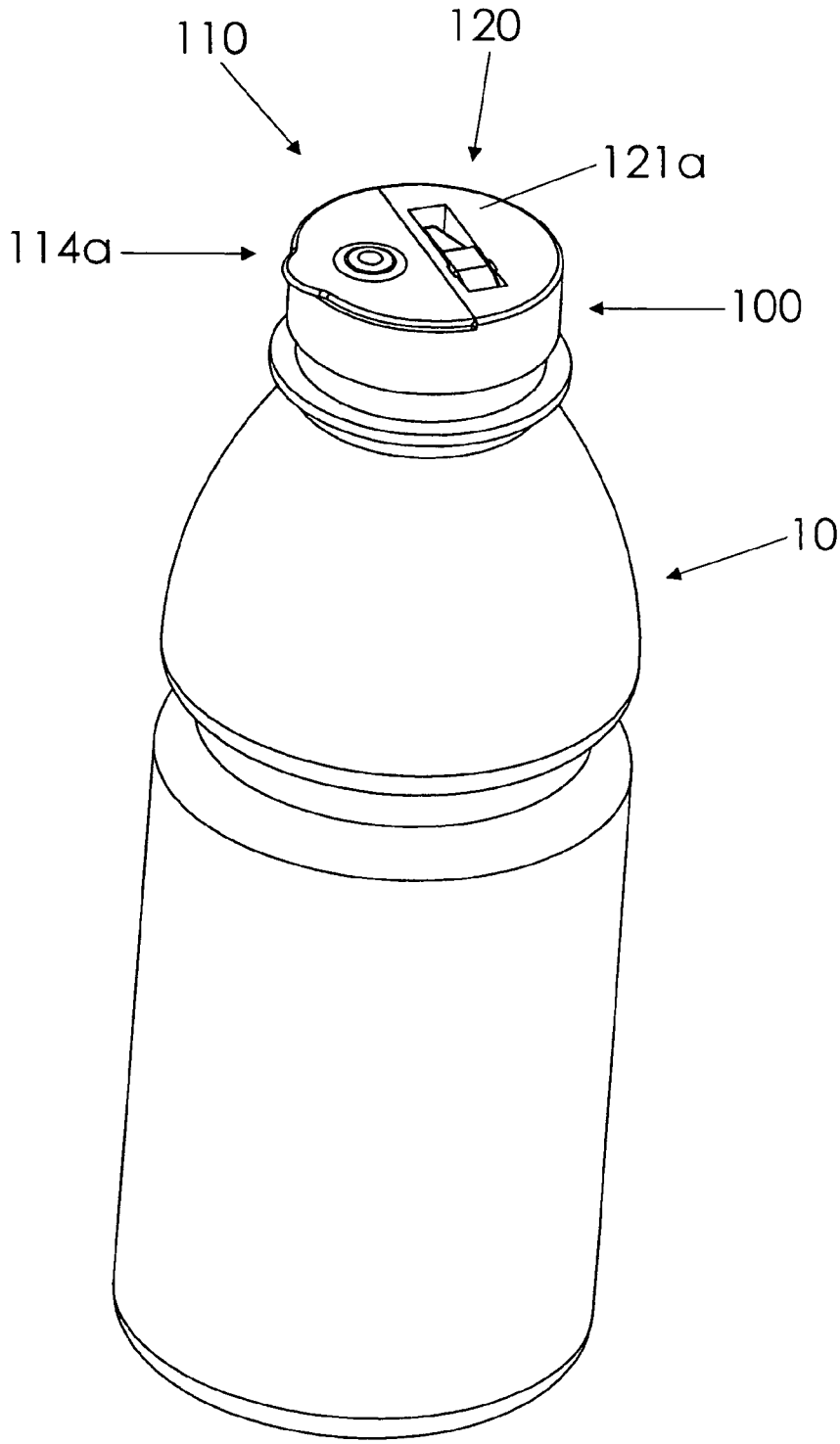
FIG. 1 is a perspective view of a cap device in use with a beverage container according to one embodiment of the present invention.

A container cap 100 according to the present invention will now be described in detail with reference to FIGS. 1 through 11 of the accompanying drawings. More particularly, according to the current invention, a cap device 100 for use with a container 10 includes first and second portions 110, 120 and means for coupling the first and second portions 110, 120 to the container 10. The first and second portions 110, 120 are adjacent one another. "Container" is used herein to refer to any beverage container (i.e., a cup, bottle, jar, or any other appropriate container).

The means for coupling the first and second portions 110, 120 to the container 10 may include, for example, at least one thread 130 having a configuration complementary to a thread of the container 10 (FIG. 3), a snap-fit configuration, and/or any other appropriate fastener.

Each portion 110, 120 includes means for selectively accessing contents of the container 10. The means of the first portion 110 for selectively accessing the container contents are different from the means of the second portion 120 for selectively accessing the container contents.

Figure 2:
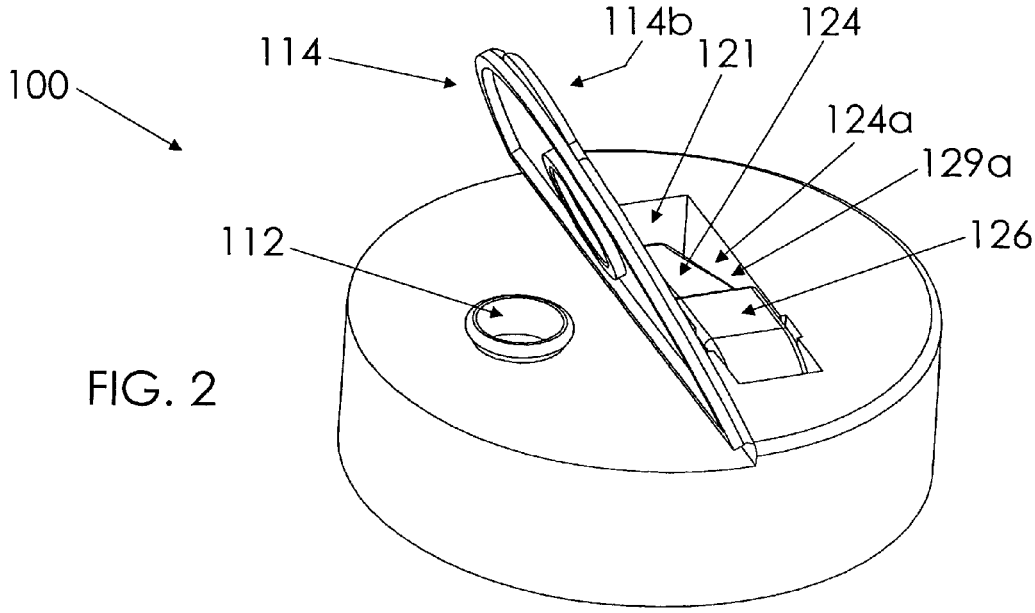
FIG. 2 is a perspective view of the cap device as in FIG. 1 removed from the container and showing a drinking implement in a retracted configuration.
Figure 9A:
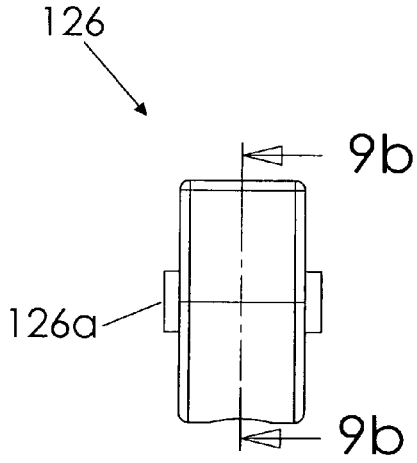
FIG. 9*a* is a side view of a first section of the drinking implement as in FIG. 6.
Figure 9B:
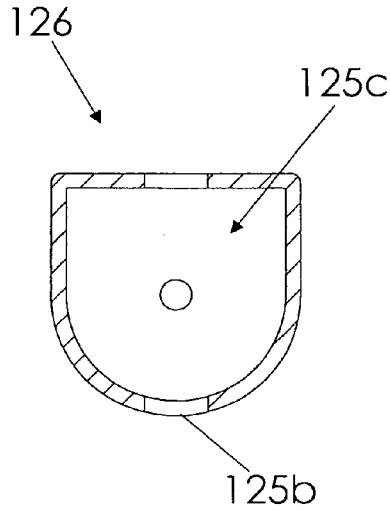
FIG. 9*b* is a sectional view taken along line 9*b*-9*b* of FIG. 9*a;*
Figure 10:
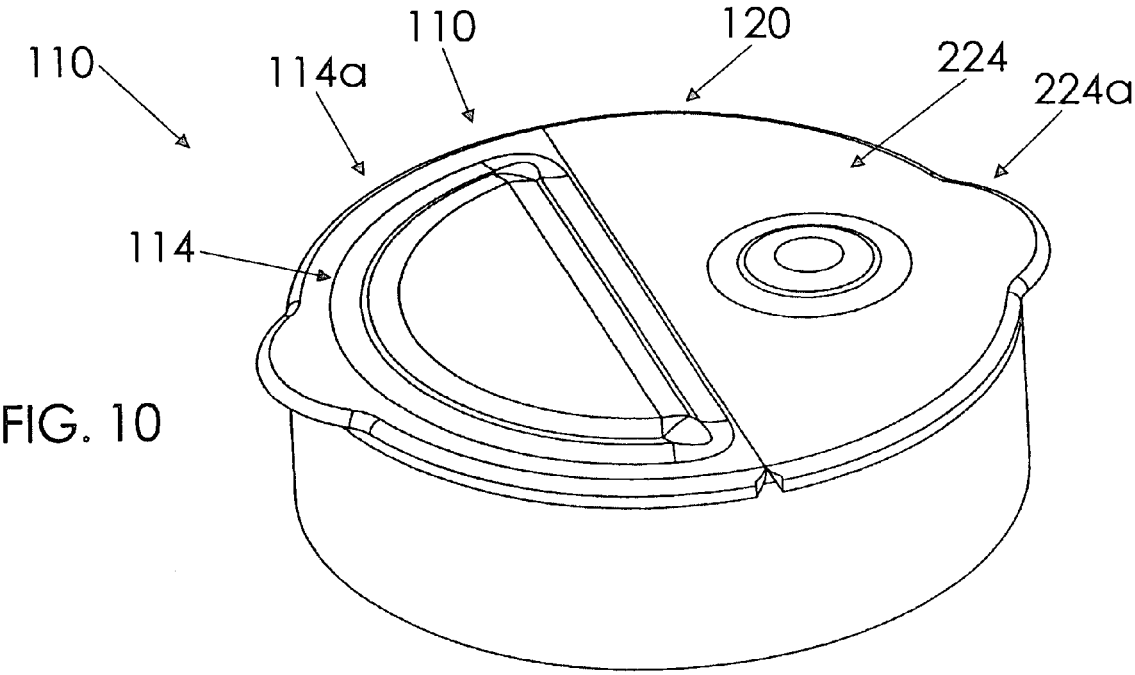
FIG. 10 is a perspective view of a cap device according to another embodiment of the present invention with respective covers in closed configurations.
Figure 11:
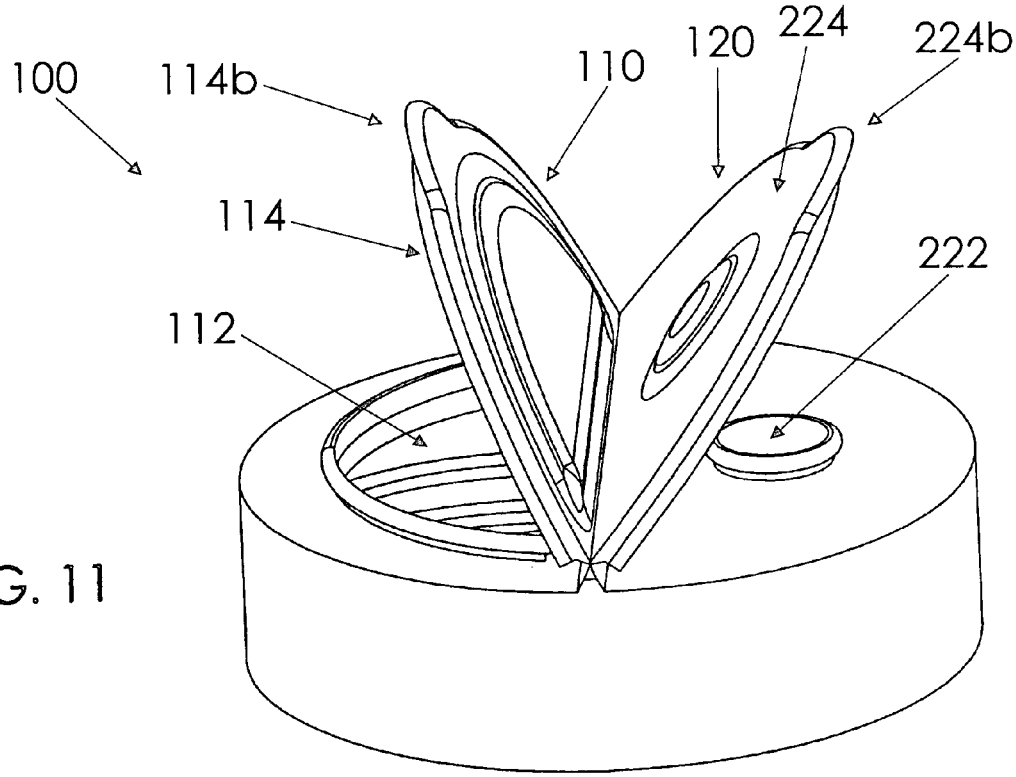
FIG. 11 is a perspective view of the cap device as in FIG. 10 with respective covers in open configurations.

As shown in FIGS. 2 through 11, the first portion means may include an opening 112 defined in the first portion 110 for providing access to contents of the container 10 and a cover 114 that is pivotal between a closed configuration 114*a* and an open configuration 114*b*. When at the closed configuration 114*a* (FIGS. 4 through 7*a* and FIG. 10), the cover 114 covers the opening 112; when at the open configuration 114*b* (FIGS. 2, 3, and 11), the cover 114 exposes the opening 112. The opening 112 may include a straw opening 112, as shown in FIG. 2, or a pour opening 112, as shown in FIG. 11. A "straw opening" is an opening that is sized to receive a straw or otherwise restrict an outpouring of contents from the container 10, while a "pour opening" is an opening that is relatively larger and unrestricted.

In one embodiment, shown in FIGS. 2 through 9*b*, the second portion means may include an access hole 122 defined by the second portion 120 and a retractable drinking implement 124. The drinking implement 124 is a structure that allows contents of the container 10 to be selectively directed out of the container 10, such as sipper. The drinking implement 124 may be rotatable between a retracted configuration 124*a* (FIG. 2) and an extended configuration 124*b* (FIGS. 4 and 5), and the drinking implement 124 may have open first and second ends 125*a*, 125*b* and define a drinking channel 125*c* therebetween (FIGS. 8*b* and 9*b*). The drinking implement 124 may close the access hole 122 (i.e., by abutment) when at the retracted configuration 124*a*, and the open second end 125*b* may be adjacent the access hole 122 when at the extended configuration 124*b* to allow contents of the container 10 to pass through the access hole 122, the open second end 125*b*, the channel 125*c*, and the open first end 125*a*.

Figure 4:
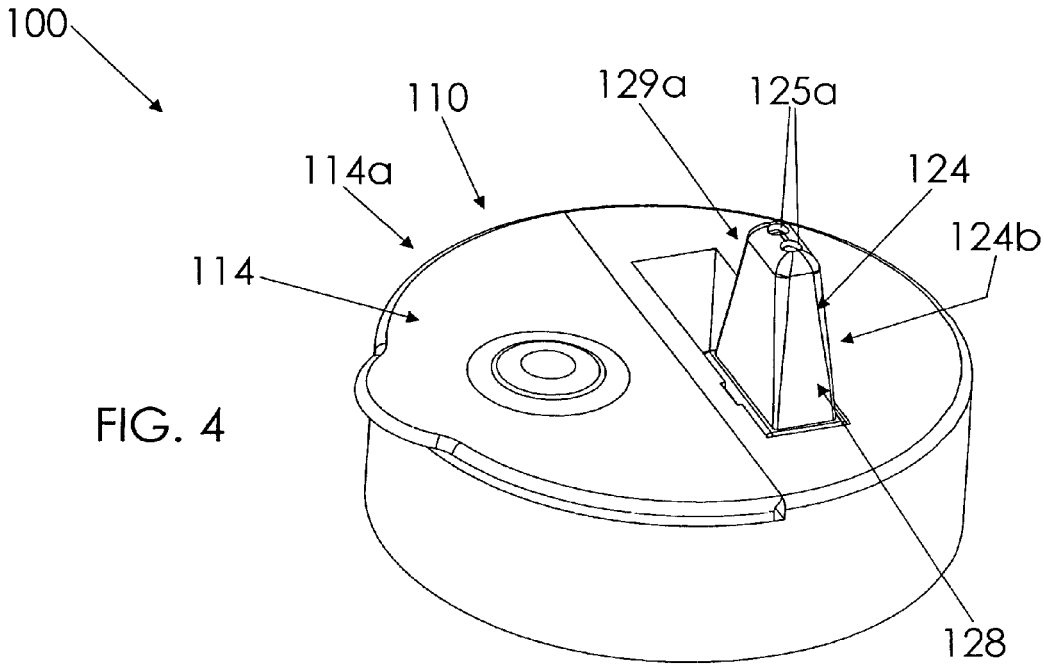
FIG. 4 is a perspective view of the cap device as in FIG. 2 with the drinking implement in an extended configuration.
Figure 5:
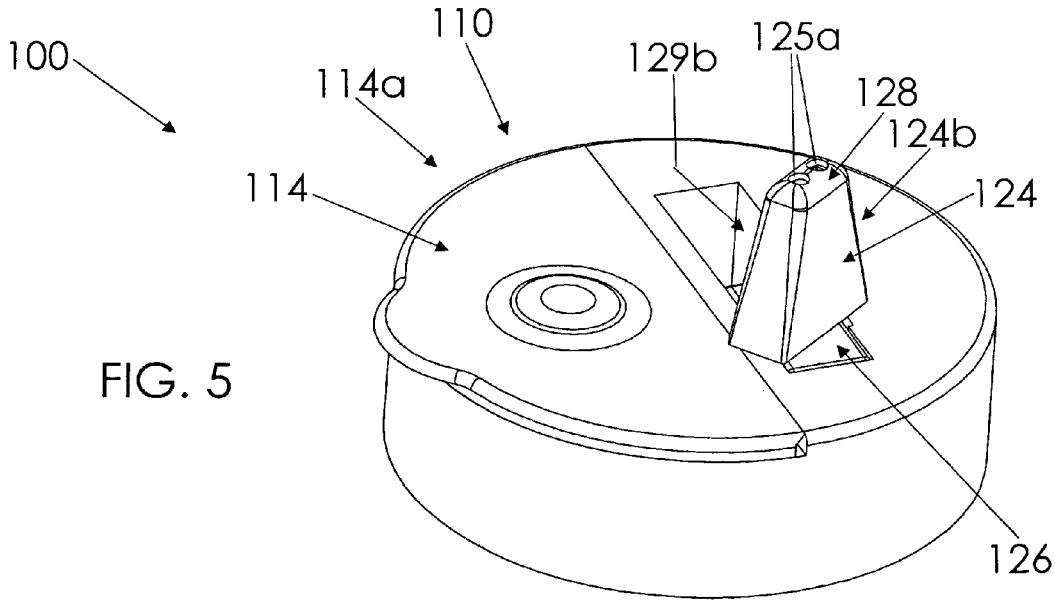
FIG. 5 is a perspective view of the cap device as in FIG. 4 with a second section of the drinking implement in a locked configuration.
Figure 6:
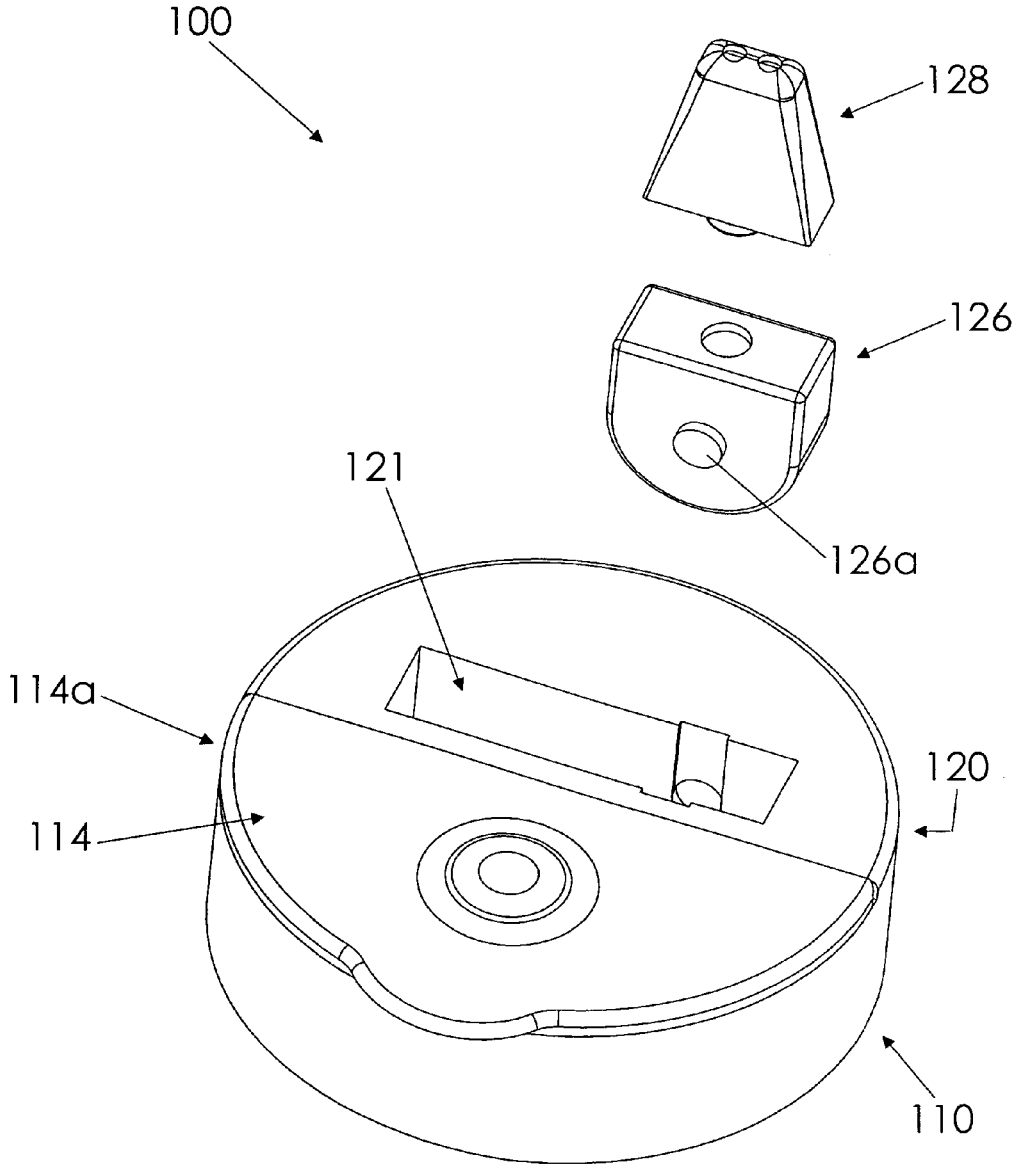
FIG. 6 is an exploded view of the cap device as in FIG. 4.

As shown in FIGS. 4 through 6 and FIGS. 8*a* through 9*b*, the drinking implement 124 may include first and second sections 126, 128. The first section 126 is pivotal (i.e., about pivot 126*a*) to move the drinking implement 124 between the retracted and extended configurations 124*a*, 124*b*, and the second section 128 is rotatable relative to the first section 126 (i.e., about pivot 128*a*) to move between a retractable configuration 129*a* (FIGS. 2 and 4) and a locking configuration 129*b* (FIG. 5). The configuration of the second section 128 may make the drinking implement 124 movable to the retracted configuration 124*a* only when the second section 128 is at the retractable configuration 129*a*, as shown in FIGS. 2 and 4, and the second section 128 may lock the first portion cover 114 at the closed configuration 114*a* (i.e., by abutment) when at the locking configuration 129*b*, as shown in FIG. 5. It is understood, however, that the second section 128 need not lock the first portion cover 114 if the first portion cover 114 were to, alternatively, not include a configuration that resulted in it being in abutment with the second section 128, for example if the cover 114 was less than a full hemispherical configuration.

The second portion 120 may have a trough 121 defining the access hole 122, and the drinking implement 124 may be coupled to the trough 121, as shown in FIGS. 2 through 7*b*. The trough 121 may allow the second portion 120 and the first portion cover 114 to collectively define a generally planar surface 121*a* when the cover 114 is at the closed configuration 114*a*. Such a generally planar surface 121*a* may be visually pleasing and/or functionally useful (e.g., for storage, shipment, ease of use, etc.). Such a trough 121 and/or planar surface 121*a* may not be required to utilize the cap device 100, however. It should also be understood that rotation of the second section 128 of the drinking implement 124 is to center it relative to a peripheral edge of the second portion 120 for more convenient use by a user desiring to drink therefrom (FIG. 5).

Figure 3:
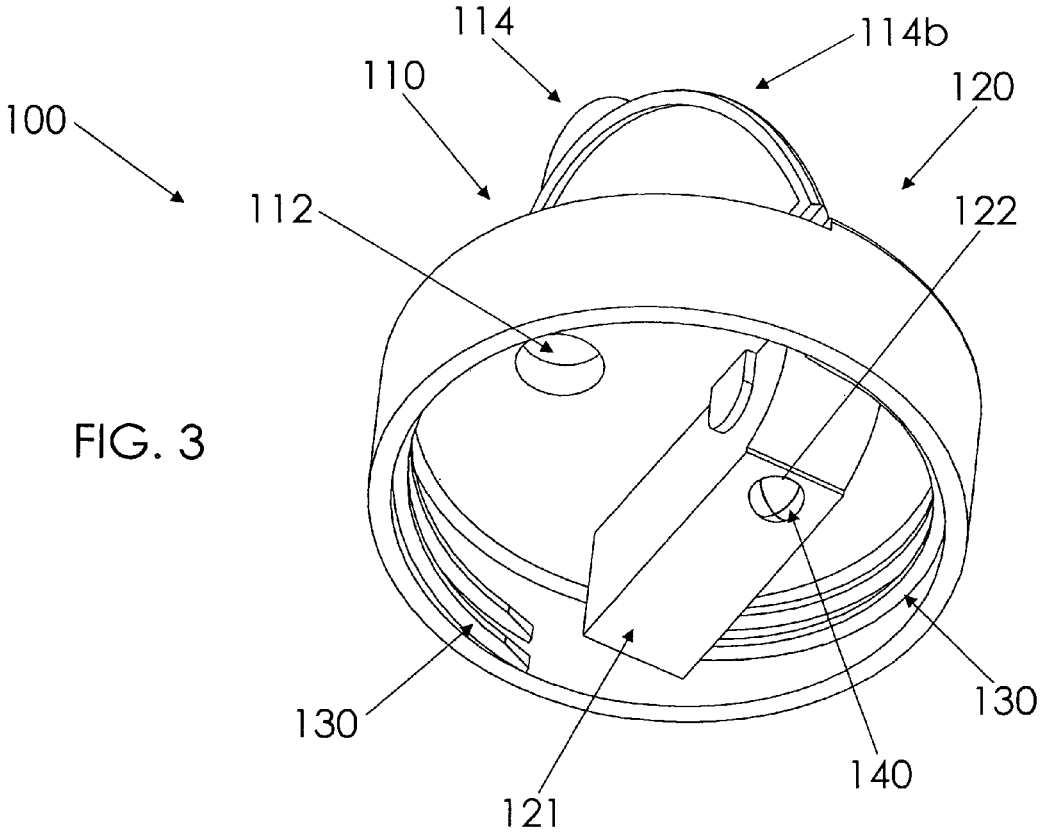
FIG. 3 is another perspective view of the cap device as in FIG. 1.
Figure 7A:
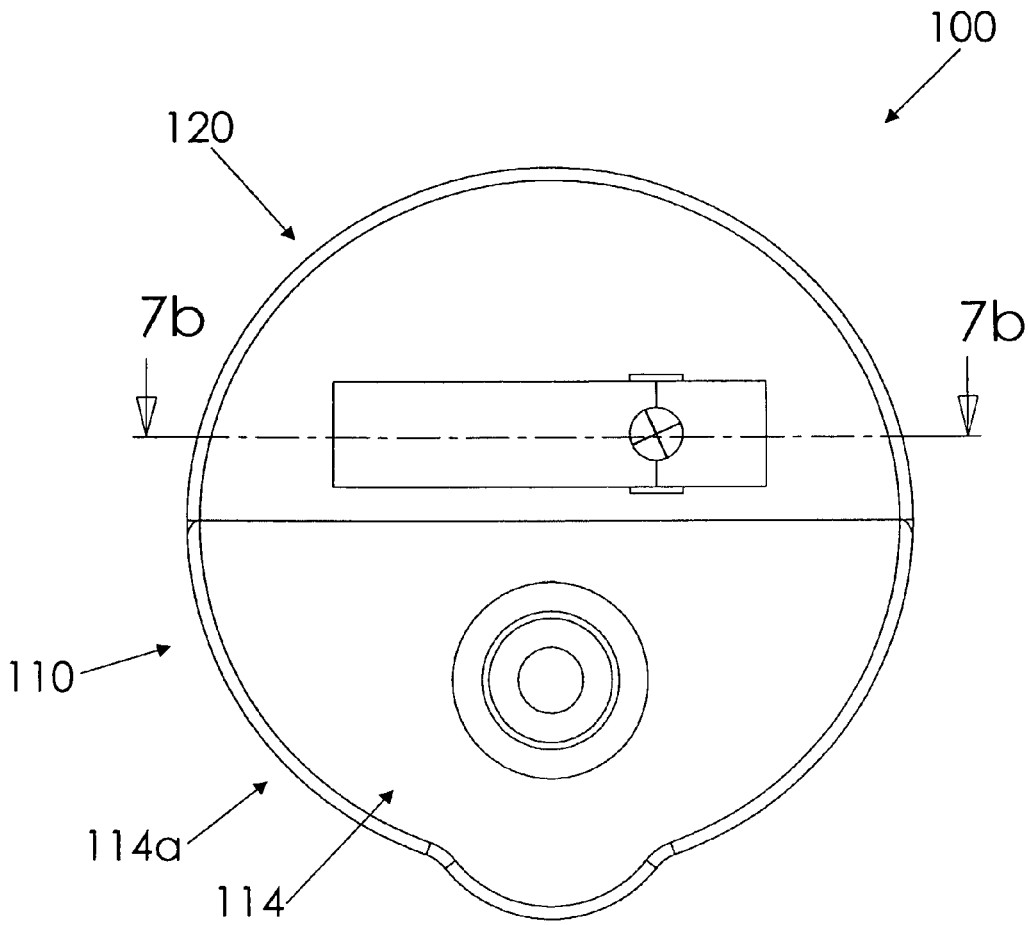
FIG. 7*a* is a top view of the cap device as in FIG. 2.
Figure 7B:
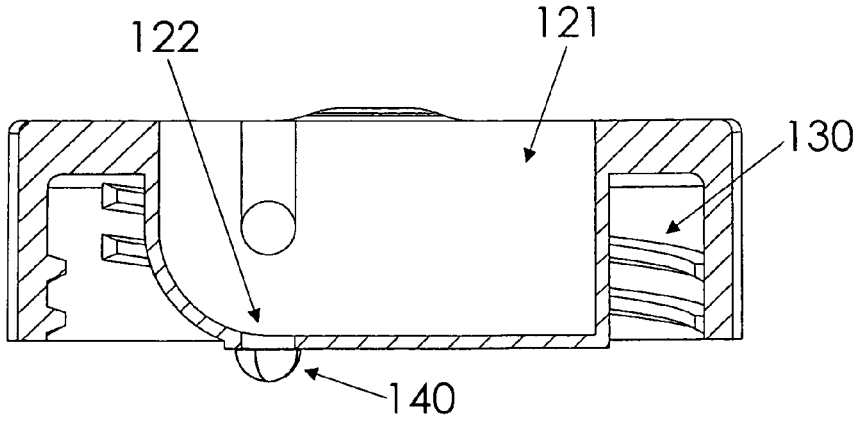
FIG. 7*b* is a sectional view of the cap device taken along line 7*b*-7*b* of FIG. 7*a;*
Figure 8A:
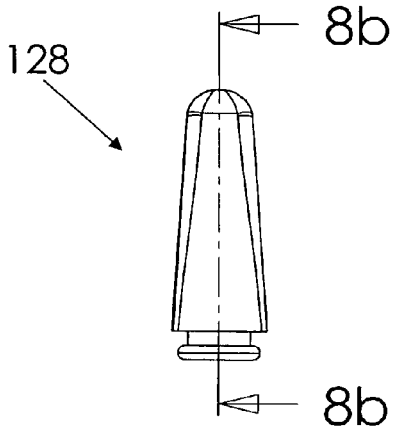
FIG. 8*a* is a side view of a second section of the drinking element as in FIG. 6.
Figure 8B:
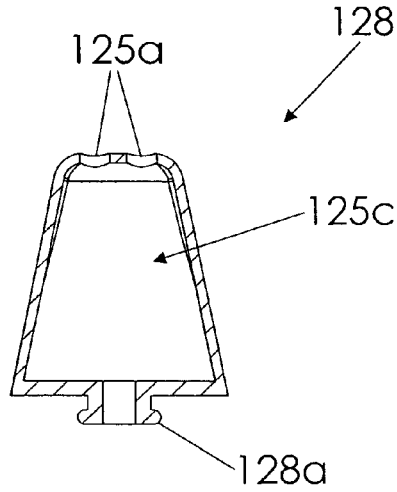
FIG. 8*b* is a sectional view taken along line 8*b*-8*b* of FIG. 8*a;*

A valve 140, as shown in FIGS. 3 and 7*b*, or an internal straw extending inside the container 10 (not shown) may be coupled to the access hole 122 to vary the functionality of the drinking implement 124. If the valve 140 is included, for example, the drinking implement 124 may act as a sipper implement (i.e., a spill-proof outlet), such as for use by children or in travel situations. If the straw is included, for example, the drinking implement 124 may pass the container's contents from the container 10 without tipping the container 10 if the user sucks from the drinking implement 124; in other words, the drinking implement 124 may be used as a typical straw.

In another embodiment, shown in FIGS. 10 and 11, the second portion means may include an opening 222 in the second portion 120 for providing access to contents of the container 10, and a cover 224 that is rotatable between a closed configuration 224*a* and an open configuration 224*b*. When at the closed configuration 224*a* (FIG. 10), the cover 224 covers the opening 222; when at the open configuration 224*b* (FIG. 11), the cover 224 exposes the opening 222. The opening 222 may be a straw opening 222 or a pour opening 112, as shown in FIG. 11.

In use, the first and second portions 110, 120 may be coupled to the container or container 10 (e.g., by thread 130), as shown in FIG. 1. The cover 114 of the first portion 110 may be moved from the closed configuration 114*a* to the open configuration 114*b*, and the user may access the contents of the container 10 through the opening 112 when the cover 114 is at the open configuration 114*b*.

If the second portion 120 includes the access hole 122 and the drinking implement 124, the drinking implement 124 may be rotated (i.e., about pivot 126*a*) from the retracted configuration 124*a* to the extended configuration 124*b*. The second section 128 may be rotated relative to the first section 126 (i.e., about pivot 128*a*) from the retractable configuration 129*a* (FIGS. 2 and 4) to the locking configuration 129*b* (FIG. 5), and when at the locking configuration 129*b*, the second section 128 may lock the cover 114 closed by abutment. This may keep the contents of the container 10 from spilling out the first portion opening 112 inadvertently. The drinking implement 124 may be used as described above to access the contents of the container 10 when at the extended configuration 124*b*.

If the second portion 120 includes the opening 222, the cover 224 may be moved from the closed configuration 224*a* to the open configuration 224*b*, and the user may access the contents of the container 10 through the opening 222 when the cover 224 is at the open configuration 224*b*. Because the opening 222 is different from the opening 112 as noted above, the user may decide to utilize opening 112 or opening 222 based on, for example, intended use.

Another embodiment of the cap device 300 is shown in FIGS. 12 to 18 of the accompanying drawings, the design of which is substantially similar to the designs described above except as specifically described below. More particularly, a container cap device 300 according to this embodiment may include a portion that will be referred to hereafter as a "spout portion." The spout portion 310 includes a trough 312 extending downwardly from an upper surface 302, the trough 312 defining an access hole. A drinking implement 316, such as a sipper spout, is coupled to the trough 312 and is pivotal within the trough between retracted and extended configurations. While the drinking implement 316 and trough 312 may have a configuration and construction substantially similar to that previously described and shown in FIGS. 1-6, it may alternatively have a construction as shown in FIGS. 12-18 and as described in more detail below.

Figure 12:
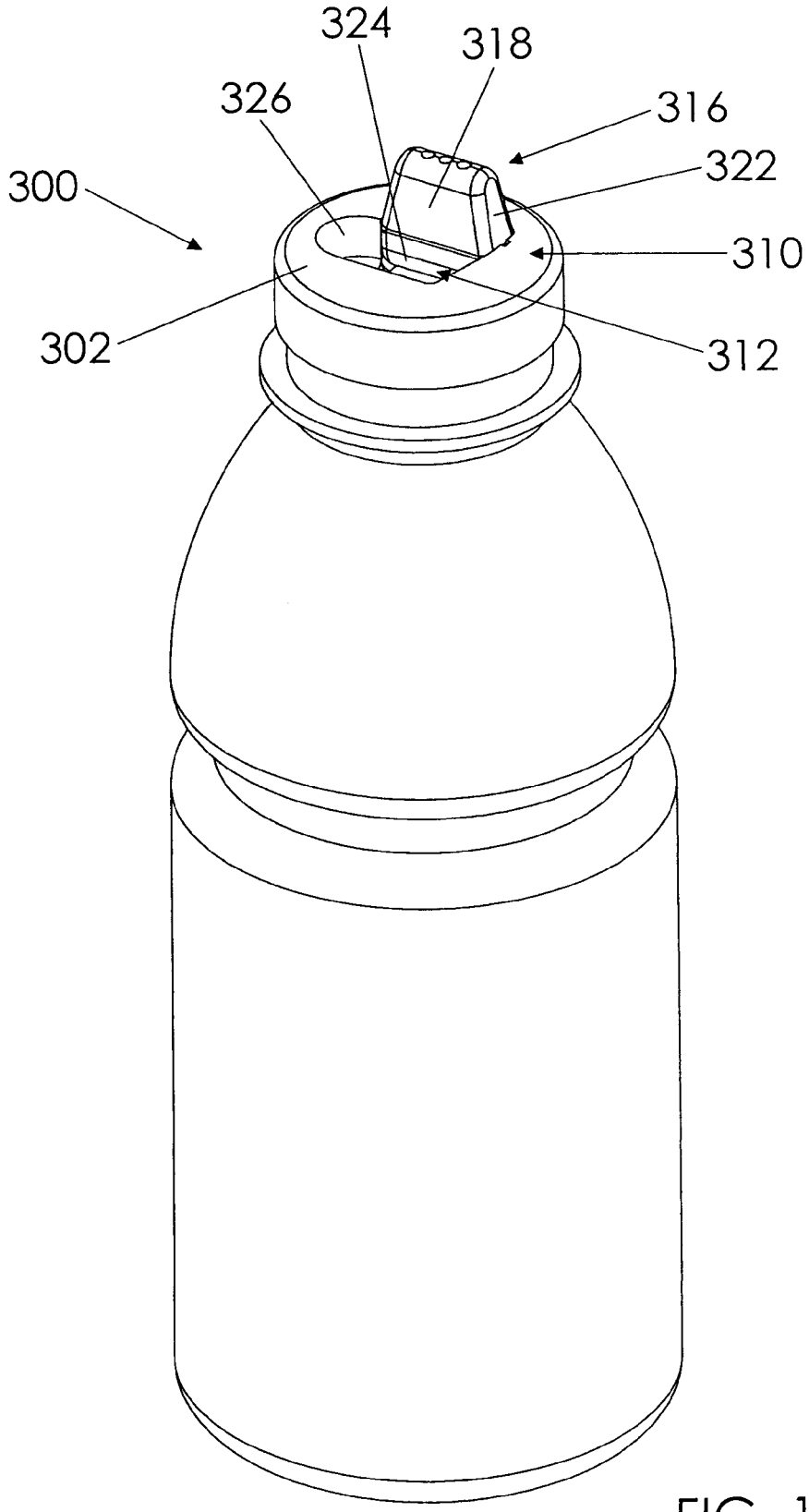
FIG. 12 is a cap device in use with a beverage container according to another embodiment of the present invention and illustrated with a drinking implement at an extended configuration.
Figure 13:
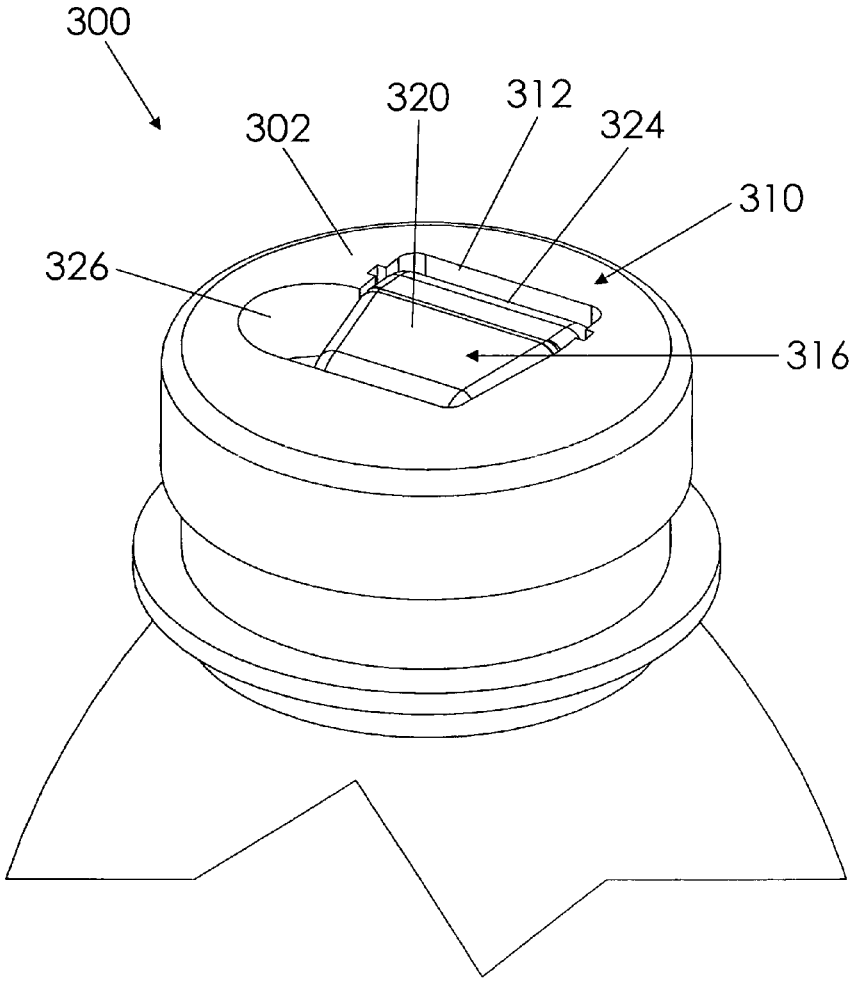
FIG. 13 is a perspective view of the cap device as in FIG. 12 removed from the container and with the drinking implement in a retracted configuration.

With specific reference to FIGS. 12 and 13, the drinking implement 316 includes opposed front 318 and rear 320 walls and opposed side walls 322 extending therebetween. The front wall 318 rests against or substantially adjacent to a lower surface of the trough 312 when the drinking implement 316 is at the retracted configuration. It is appreciated that the rear wall 320 of the drinking implement 316 is generally planar with the upper surface 302 of the spout portion 310 when at the retracted configuration. The drinking implement 316 may be pivotal about a fastener or integrated hinge 324 that extends between the side walls 322 along a lower extent of the front 318 and rear 320 walls of the drinking implement 316.

In addition, the upper surface 302 of the spout portion 310 may define a cavity 326 adjacent to and in communication with the trough 312. Preferably, the cavity 326 includes a configuration suitable to receive a finger of a person such that the drinking implement 316 may be selectively moved more easily from the retracted configuration (FIG. 13) to the extended configuration (FIG. 12).

Figure 14:
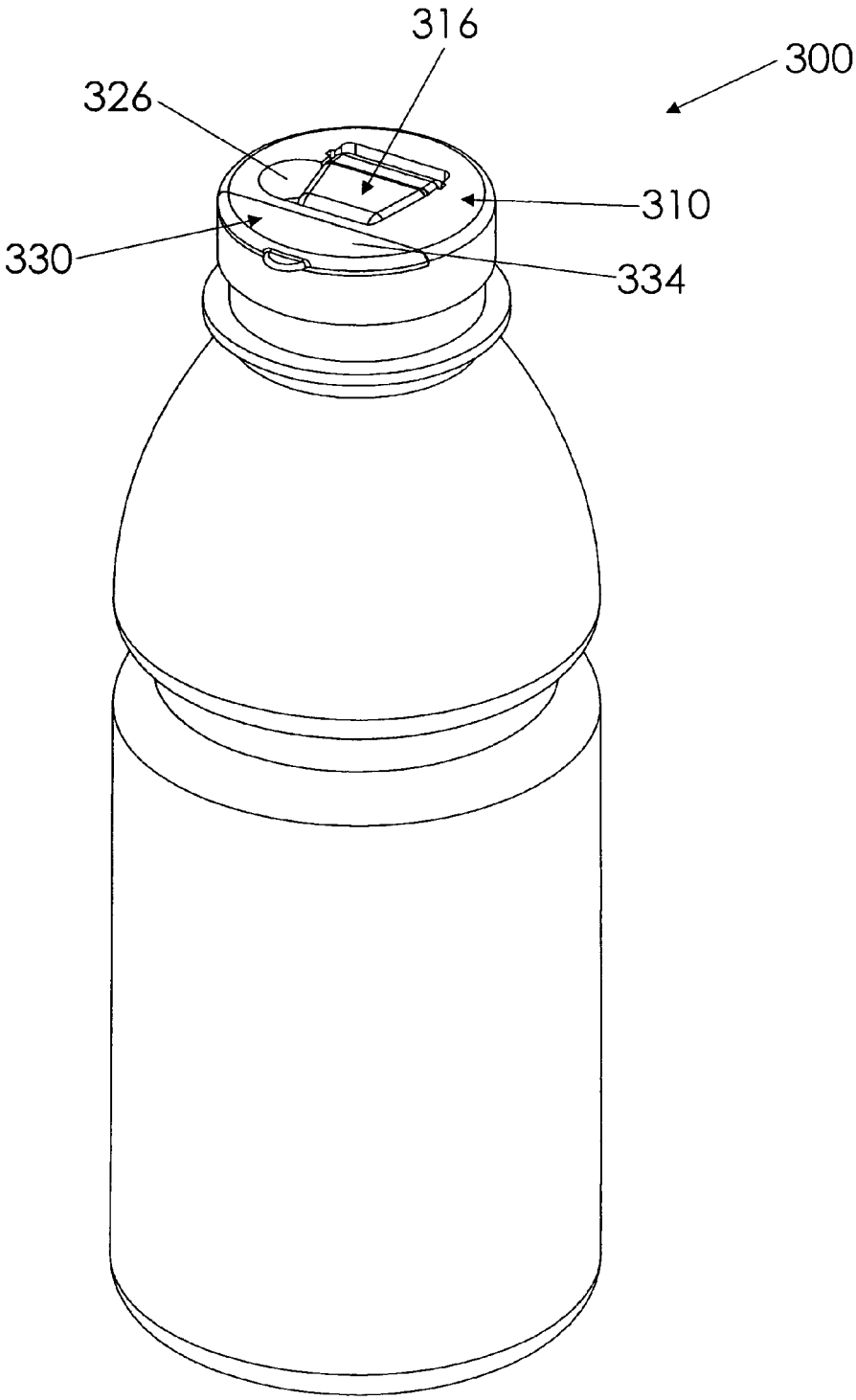
FIG. 14 is a perspective view of a cap device according to another embodiment of the present invention having a spout portion and a pour portion.
Figure 15:
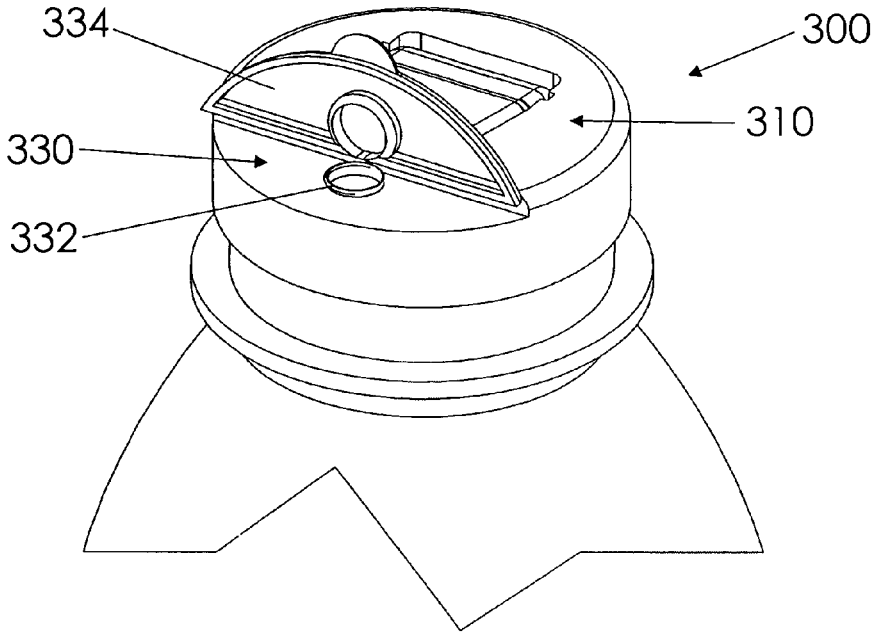
FIG. 15 is an isolated view on an enlarged scale of the cap device as in FIG. 14 with a cover of the pour portion being illustrated at an open configuration and the drinking implement of the spout portion being illustrated at retracted configuration.
Figure 16:
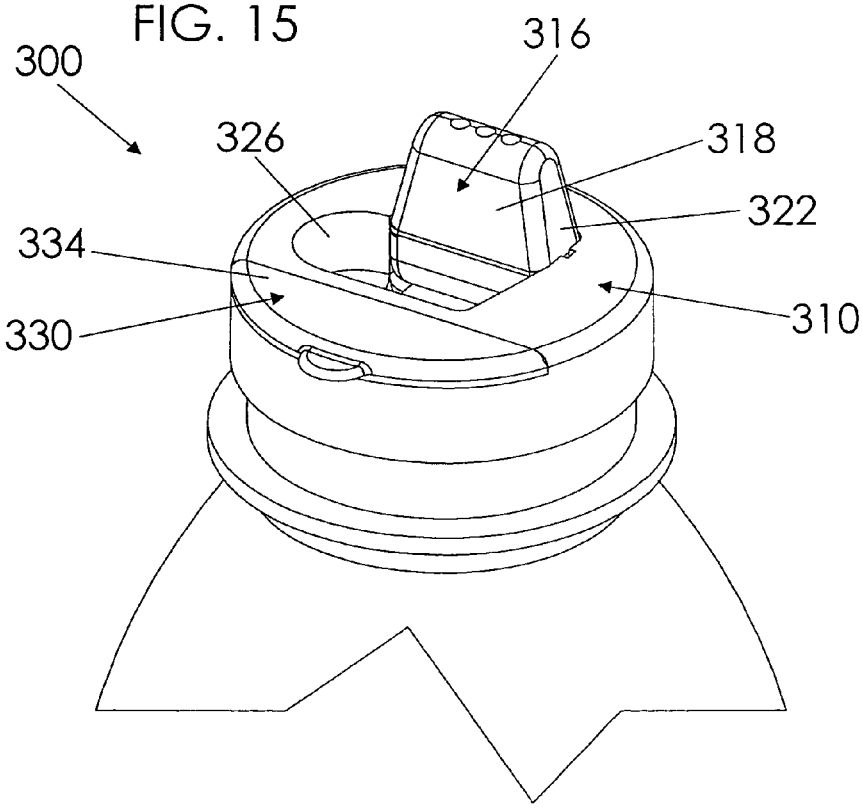
FIG. 16 is an isolated view on an enlarged scale of the cap device as in FIG. 14 with a cover of the pour portion being illustrated at a closed configuration and the drinking implement of the spout portion at an extended configuration.
Figure 17:
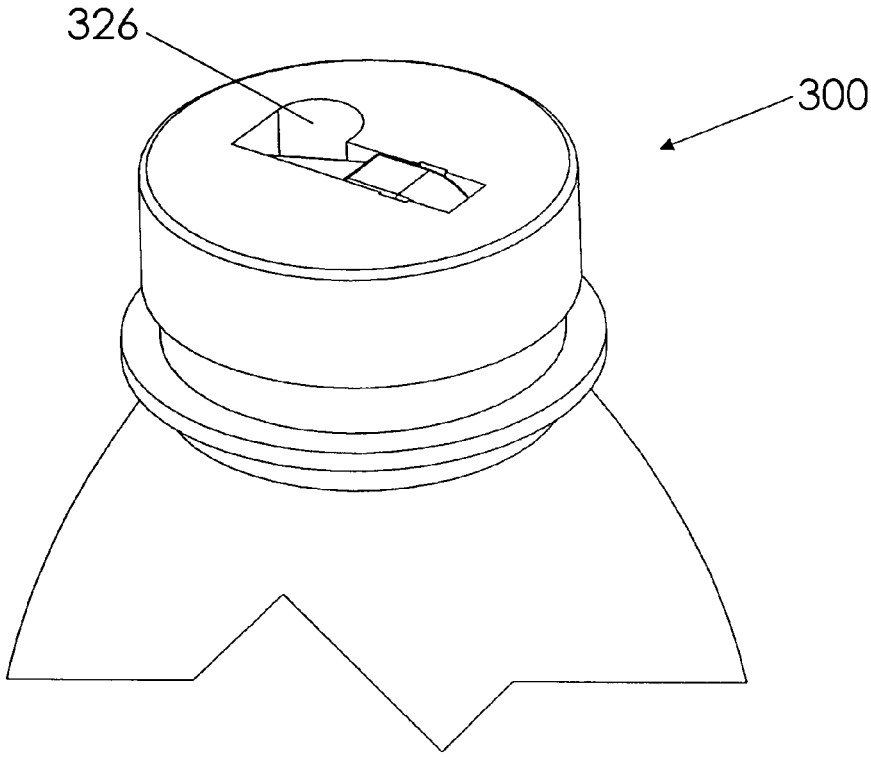
FIG. 17 is a perspective view of a cap device in use with a beverage container as in FIG. 13 except that the drinking implement is pivotally movable side to side rather than in a forward and rearward movement, said drinking implement being illustrated in a retracted configuration.
Figure 18:
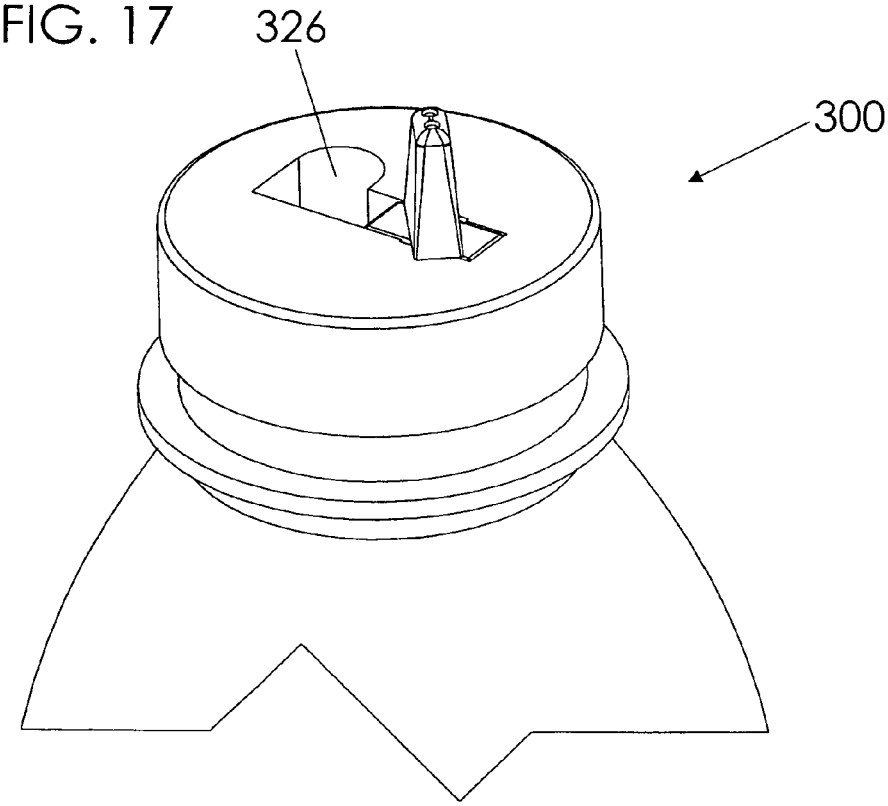
FIG. 18 is another perspective view as in FIG. 17 with the drinking implement being illustrated at an extended configuration.

As shown in FIGS. 14-16, a portion that will be referenced herein as the "pour portion" 330, may be situated adjacent to the spout portion 310. Having a construction substantially similar to the portion 110 described previously, the pour portion 330 defines an opening 332 for providing access to contents within a container and a cover 334 that is pivotal between a open configuration exposing the opening 332 (FIG. 15) and a closed configuration covering the opening 332 (FIG. 16). The opening 332 may be configured for receiving a straw or a larger opening suitable for pouring the contents from a container. It should be appreciated that the spout portion 310 accounts for a larger proportion of the cap device 300 than the pour portion 330. In other words, a mathematical area of the spout portion 310 is greater than an area of the pour portion 330.

It is understood that while certain forms of this invention have been illustrated and described, it is not limited thereto except insofar as such limitations are included in the following claims and allowable functional equivalents thereof.

The invention claimed is:

1. A cap device for use with a container, said device comprising:

a spout portion having a trough, said trough defining an access hole;

a drinking implement coupled to said trough and being pivotal between a retracted configuration and an extended configuration; said drinking implement defining open first and second ends and defining a drinking channel therebetween; said drinking implement closing said access hole by abutment when at said retracted configuration; said drinking implement open second end being adjacent said access hole when at said extended configuration to allow contents of said container to pass through said access hole, said open second end, said channel, and said open first end;

means for coupling said spout portion to said container;

wherein:

said drinking implement includes opposed front and rear walls and opposed side walls extending between respective front and rear walls;

said one of said side walls of said drinking implement bears against a lower surface of said trough and another of said side walls is generally planar with an upper surface of said spout portion when said drinking implement is at said retracted configuration;

said drinking implement has first and second sections;

said first section is pivotal to move said drinking implement between said retracted and extended configurations;

said second section is rotatable relative to said first section to move between a retractable configuration and a locking configuration; and said drinking implement is movable to said retracted configuration only when said second section is at said retractable configuration.

2. The device as in claim 1, wherein:

said drinking implement includes opposed front and rear walls and opposed side walls extending between respective front and rear walls;

said front wall of said drinking implement bearing against a lower surface of said trough and said rear wall being generally planar with an upper surface of said spout portion when said drinking implement is at said retracted configuration.

3. The device as in claim 2, further comprising:

a pour portion defining an opening for providing access to contents of said container and a cover pivotal between a closed configuration covering said opening and an open configuration exposing said opening;

wherein said pour portion is adjacent said spout portion.

4. The device as in claim 3, wherein:

said spout portion defines a cavity adjacent said trough, said cavity being in communication with said trough and having a configuration so as to receive a person's finger therein to selectively move said drinking implement from said retracted configuration to said extended configuration.

5. The device as in claim 4, wherein either a valve or an internal straw extending inside said container is coupled to said access hole.

6. The device as in claim 1, wherein said spout portion defines a cavity adjacent said trough, said cavity being in communication with said trough and having a configuration so as to receive a person's finger therein to selectively move said drinking implement from said retracted configuration to said extended configuration.

7. The device as in claim 1 wherein either a valve or an internal straw extending inside said container is coupled to said access hole.

8. The device as in claim 1 further comprising:

a pour portion defining an opening for providing access to contents of said container and a cover pivotal between a closed configuration covering said opening and an open configuration exposing said opening; and wherein said pour portion is adjacent said spout portion.

9. The device as in claim 8 wherein said cover and said spout portion collectively define a generally planar surface when said cover is at said closed configuration.

10. The device as in claim 8, wherein an area of said spout portion is larger than an area of said pour portion.

11. The device as in claim 1, further comprising:

a pour portion defining an opening for providing access to contents of said container and a cover pivotal between a closed configuration covering said opening and an open configuration exposing said opening; and wherein said pour portion is adjacent said spout portion.

12. The device as in claim 11, wherein:

said spout portion defines a cavity adjacent said trough, said cavity being in communication with said trough and having a configuration so as to receive a person's finger therein to selectively move said drinking implement from said retracted configuration to said extended configuration.

13. The device as in claim 11, wherein:

said drinking implement has first and second sections;

said first section is pivotal to move said drinking implement between said retracted and extended configurations;

said second section is rotatable relative to said first section to move between a retractable configuration and a locking configuration; and said drinking implement is movable to said retracted configuration only when said second section is at said retractable configuration.

14. A cap device for use with a container, said device comprising:

a spout portion having a trough, said trough defining an access hole;

a drinking implement coupled to said trough and being pivotal between a retracted configuration and an extended configuration; said drinking implement defining open first and second ends and defining a drinking channel therebetween; said drinking implement closing said access hole by abutment when at said retracted configuration; said drinking implement open second end being adjacent said access hole when at said extended configuration to allow contents of said container to pass through said access hole, said open second end, said channel, and said open first end;

means for coupling said spout portion to said container; and wherein said spout portion defines a cavity adjacent said trough, said cavity being in communication with said trough and having a configuration so as to receive a person's finger therein to selectively move said drinking implement from said retracted configuration to said extended configuration;

wherein:

said drinking implement includes opposed front and rear walls and opposed side walls extending between respective front and rear walls;

said front wall bearing against a lower surface of said trough and said rear wall being generally planar with an upper surface of said spout portion when said drinking implement is at said retracted configuration;

a pour portion defining an opening for providing access to contents of said container and a cover pivotal between a closed configuration covering said opening and an open configuration exposing said opening;

wherein said pour portion is adjacent said spout portion;

wherein:

said drinking implement has first and second sections;

said first section is pivotal to move said drinking implement between said retracted and extended configurations;

said second section is rotatable relative to said first section to move between a retractable configuration and a locking configuration; and said drinking implement is movable to said retracted configuration only when said second section is at said retractable configuration.

15. The device as in claim 14, wherein an area of said spout portion is larger than an area of said pour portion.

* * * * *